United States Patent [19]

Roth

[11] 4,110,509

[45] Aug. 29, 1978

[54] PROCESS FOR IMPARTING FLAME RESISTANCE TO CELLULOSIC TEXTILE MATERIALS AND CELLULOSIC MATERIALS OBTAINED THEREBY

[75] Inventor: Philip B. Roth, Bridgewater, N.J.

[73] Assignee: American Cyanamid Company, Stamford, Conn.

[21] Appl. No.: 780,376

[22] Filed: Mar. 23, 1977

[51] Int. Cl.[2] ..... B05D 3/10; B05D 3/12

[52] U.S. Cl. ..... 428/276; 8/116 P; 427/177; 427/341; 427/342; 427/354; 428/921

[58] Field of Search ..... 427/341, 342, 390 D, 427/354, 177; 8/116 P; 428/276, 277, 921

[56] References Cited

U.S. PATENT DOCUMENTS

| | | | |
|---|---|---|---|
| 2,983,623 | 5/1961 | Coates | 427/354 X |
| 3,775,155 | 11/1973 | Eggenweiler et al. | 427/341 X |
| 3,928,676 | 12/1975 | Drelich et al. | 427/341 |

OTHER PUBLICATIONS

Speel, Textile Chemicals and Auxiliaries, second edition, 1957, New York, Reinhold Publishing Corporation, New York, p. 84.

*Primary Examiner*—Ronald H. Smith
*Assistant Examiner*—Evan K. Lawrence
*Attorney, Agent, or Firm*—H. G. Jackson

[57] ABSTRACT

A process and product obtained thereby are disclosed wherein a cellulosic textile material is impregnated with an aqueous solution of a condensation product of tetrakis(hydroxymethyl)phosphonium sulfate and urea, partially dried, impregnated with a thickened solution of ammonium hydroxide, rolled and stored in a container, unrolled, rinsed with water and dried to obtain durable flame retardance.

14 Claims, No Drawings

PROCESS FOR IMPARTING FLAME RESISTANCE TO CELLULOSIC TEXTILE MATERIALS AND CELLULOSIC MATERIALS OBTAINED THEREBY

BACKGROUND OF THE INVENTION

1. Field of the Invention

This invention is a process for imparting durable flame retardance to cellulosic textile materials. More particularly, it is a process for imparting durable flame retardance to cotton fabric by impregnating the fabric with a condensation product of tetrakis (hydroxymethyl)phosphonium sulfate and urea and treating the impregnated fabric with a thickened solution of ammonium hydroxide.

2. Description of the Prior Art

U.S. Pat. No. 2,772,188 discloses a process whereby a cellulosic textile material is impregnated with an aqueous solution of a polymerizable methylol-phosphorus polymeric material, containing at least one free methylol group attached to a phosphorus atom; drying the impregnated cellulosic material; and insolubilizing the polymer in situ by contacting it with ammonia. The ammonia may be in the form of gaseous ammonia, ammonium hydroxide, a solution of ammonia in an inert solvent, or as ammonia released in situ by the reaction of a compound capable of releasing ammonia, e.g., an ammonium salt of a weak acid, such as ammonium acetate, or ammonium carbonate.

Using an aqueous ammonia system, such as ammonium hydroxide, or a solution of ammonium carbonate, further polymerization is very rapid and is complete in a few minutes at room temperature, since the ammonia readily penetrates the cellulosic material and rapid curing occurs. Moreover, the aqueous medium absorbs the heat generated by the crosslinking reaction of the ammonia and the polymer. However, in such systems there is a tendency for the polymerizable methylol-phosphorus polymeric material to migrate to the surface of the material before having been immobilized by reaction with the ammonia. This is especially the case if the impregnated cellulose material has not been properly dried.

U.S. Pat. No. 2,983,623 discloses a process wherein a polymerizable methylol phosphorus polymeric material, containing at least one free methylol group attached to a phosphorus atom, is impregnated onto a cellulosic material; the cellulosic material is thoroughly dried, treated with gaseous ammonia, and then treated with aqueous ammonia. However, this process requires thorough drying of the cellulosic material before exposure to the gaseous ammonia and a secondary treatment with aqueous ammonia.

In both of the above-mentioned patents the polymerizable methylol phosphorus polymeric material may be a condensation product formed by reacting tetrakis(hydroxymethyl)phosphonium chloride, or tris(hydroxymethyl)phosphine oxide, or mixtures thereof, with urea.

The process of this invention differs from the processes of U.S. Pat. Nos. 2,772,188 and 2,983,623 (1) in the composition of the condensation product used, (2) in that the moisture content of the dried material is not critical, and (3) in that the ammoniation is carried out in thickened ammonium hydroxide.

In copending, commonly assigned, U.S. patent application, Ser. No. 665,014, now abandoned filed Mar. 8, 1976, a process is disclosed for imparting flame retardancy to cellulosic textile materials by applying thereto novel condensation products of tetrakis(hydroxymethyl)phosphonium sulfate and urea; partially drying the treated textile material, and exposing the partially-dried textile material to gaseous ammonia to effect an insolubilization of the condensation product thereon.

The process of this invention differs from that process in that the treated fabric is not partially dried to a critical moisture content, and in that the condensation product is not insolubilized with gaseous ammonia.

The process of this invention offers the following advantages over the aforementioned processes:

1. It is not necessary to dry the impregnated cellulosic textile material to a critical moisture content.

2. The thickened ammonium hydroxide gives better contact than gaseous ammonia and hence the process gives more uniform results.

3. The increased viscosity of the ammonium hydroxide prevents, or minimizes, the migration of the polymerizable condensation product of tetrakis(hydroxymethyl)phosphonium sulfate and urea to the surface of the cellulosic material before it is immobilized by reaction with ammonia 4. There is no need for a treatment with gaseous ammonia before the treatment with the thickened ammonium hydroxide.

5. The use of the tetrakis(hydroxymethyl)phosphonium sulfate avoids the possibility of formation of bis(chloromethyl)ether, which is very toxic. (See Collier, Environmental Science and Technology, Vol. 6, No. 10, page 930, 1972).

SUMMARY OF THE INVENTION

The present invention provides a process whereby cellulosic textile materials are rendered durably flame retardant by impregnation with an aqueous solution of a condensation product of tetrakis(hydroxymethyl)phosphonium sulfate and urea, to deposit thereon about 3–7% by weight of phosphorus; partially drying the impregnated material; impregnating the partially dried material with a thickened solution of ammonium hydroxide at about 20°–60° C; rolling the impregnated material and storing the same at ambient temperature in a container for about ½–60 minutes; recovering the material from the container, unrolling, and contacting the unrolled material with water and drying.

DESCRIPTION OF THE PREFERRED EMBODIMENTS

In carrying out the process of this invention an aqueous solution of a condensation product of tetrakis(hydroxymethyl)phosphonium sulfate and urea, hereinafter referred to as XYZ, is prepared and applied to a cellulosic textile material.

The aqueous solution of XYZ can be prepared by adding urea to an aqueous solution of tetrakis(hydroxymethyl)phosphonium sulfate, represented by the formula:

$$[(HOCH_2)_4 P]_2^+ SO_4^=,$$

although some acid sulfate represented by the formula:

$$[(HOCH_2)_4 P]^+ H^+ SO_4^=,$$

may also be present in minor amounts; and heating the resulting mixture, at a temperature from about 60° C to reflux temperature, for a period of about ½-2 hours. Preferably, the reaction mixture is heated at 95°-100° C for a period of about ½ hour. The reaction mixture should contain about 4.0-9.0, preferably about 5.0-7.5 parts by weight of tetrakis(hydroxymethyl)phosphonium sulfate per part by weight of urea charged. After the heating period the solution is cooled to room temperature, either slowly or rapidly, to obtain a final solution which contains from about 68-72% solids and a pH of about 2-5. The solution of XYZ contains about 10% phosphorus.

The aqueous solution of tetrakis(hydroxymethyl)-phosphonium sulfate (Solution A) can be prepared by reacting in aqueous medium 1 mole of tris(hydroxymethyl)phosphine (THP) with at least 1 mole of formaldehyde and essentially ½ mole of sulfuric acid. Sufficient sulfuric acid is used to provide between 0.45 and 0.50 mole of real sulfuric acid per mole of THP. The formaldehyde should be used in an amount sufficient to provide one mole of formaldehyde per mole of THP. The formaldehyde can be in the form of an aqueous solution or as paraformaldehyde. When the initial exothermic reaction subsides, the temperature of the mixture is held at about 30° C for about 4 hours. The reaction temperature should be between 20° C and 100° C, preferably between 25° C and 50° C.

THP is a known compound, the preparation of which is disclosed in U.S.S.R. Pat. No. 138,617 (1960). A preparation by the reaction of phosphine with formaldehyde is described in German Pat. No. 1,035,135.

Solution A, as prepared, will contain a solids content related to the amounts of materials used originally. Generally, the product contains between 75% and 85% by weight of real tetrakis(hydroxymethyl)phosphonium sulfate and contains between 11.5% and 13% phosphorus as phosphonium phosphorus. The solution may also contain some free formaldehyde and sulfuric acid.

An application solution is prepared containing about 30-70%, preferably about 35-55%, of the solution of XYZ, and about 0.1% real, of a suitable surfactant. The application solution has a pH of about 2.5-6, preferably about 4-5. Optionally, an acid-binding agent may also be included.

The concentration of phosphorus in the application solution of XYZ will depend on the intended method of application, the amount of phosphorus to be applied, and on the weight and structure of the textile material used. Generally, the application solution contains from about 3 to about 7 percent, preferably from about 3.5 to about 5 percent, by weight of phosphorus.

The surfactant employed in the application solution of XYZ may be cationic, anionic, or nonionic. Preferably, the surfactant is nonionic. Illustrative examples of suitable surfactants include the following:

nonylphenol-ethylene oxide polyether alcohols,
trimethylnonyl polyethylene glycol ether,
octylphenoxy polyethoxy ethanol,
isooctylphenoxy polyethoxy ethanol, and the
dihexyl ester of sodium sulfosuccinic acid.

The preferred surfactant is trimethylnonyl polyethylene glycol ether.

Illustrative examples of suitable acid-binding agents include sodium acetate, ammonium acetate, sodium carbonate, sodium bicarbonate, potassium hydroxide, and the like. The preferred acid-binding agent is sodium acetate.

A second application solution of thickened ammonium hydroxide is prepared by adding a suitable water-soluble thickening agent to an aqueous solution containing from about 17 to about 29 percent, preferably from about 25 to about 29 percent, by weight of ammonia. Sufficient thickening agent is added to provide a solution having a viscosity from about 500 to about 10,000 centipoises, preferably from about 1,000 to about 3,000 centipoises, as measured with a Brookfield viscometer at 25° C.

Illustrative of the water-soluble thickening agents which may be used in the preparation of the thickened ammonium hydroxide are the following:

carboxymethyl cellulose,
carbo-seed ether,
sodium alginate,
concentrated starch paste,
highly hydroxyethylated cellulose,
anionic heteropolysaccharide,
purified carbo-seed ether,
hydroxypropyl cellulose, and the like.

The preferred thickening agent is water-soluble hydroxyethyl ether of cellulose (Natrosol ® 250, Hercules Powder Company).

The temperature of the thickened ammonium hydroxide may range from about 20° C to about 60° C. Preferably, the temperature ranges from about 30° C to about 45° C.

The general application procedure involves impregnating a 100% cellulosic textile material, preferably 100% cotton duck or sheeting, with the application solution of XYZ to deposit thereon from about 3.0 to about 7.0 percent by weight of phosphorus, based on the weight of the untreated textile material. The percentage of phosphorus applied may be readily calculated from the percent by weight of phosphorus in the application solution and the percent by weight wet pickup of the impregnated textile material, based on the weight of the untreated material.

Any suitable method may be used for impregnating the textile material with the application solution of XYZ. Padding, spraying, and dipping, with or without the use of vacuum impregnation, are suitable methods. The excess application solution may be removed, if necessary, by squeezing, centrifuging, and the like.

Preferably, a piece of cotton duck or sheeting is passed through a pad bath containing the application solution of XYZ to impregnate the fabric, and passed between squeeze rolls to remove excess solution and deposit thereon from about 3.5 percent to about 5.0 percent phosphorus, based on the weight of the untreated material.

The material impregnated with the application solution is then dried at about 87.8° C to a moisture content of about 3-20%, although the water-content is not critical; then impregnated with the thickened ammonium hydroxide solution to obtain about a 40 percent wet pick-up and deposit thereon from about 2 to about 6, preferably from about 4 to about 5, grammoles of ammonia per gram-atom of phosphorus thereon.

Any suitable method can be used for impregnating the treated cotton material with the thickened ammonium hydroxide, such as dipping, padding or knife coating. The excess material may be removed by passing the treated material through a slit, between squeeze rolls, or over knife edges, and the like.

The impregnated material is then batch-rolled and stored in a suitable sealed container, such as a polyethylene bag, at ambient temperature for a period from about 0.5 to about 60 minutes, preferably from about 1 to about 5 minutes, to allow the formation of an insoluble polymer within the material. The treated material is then contacted with water, preferably rinsed with a water spray, and dried by conventional methods, such as tumble drying or drying over heated cans.

However, it is preferable to subject the ammoniated textile material, as described above, to an oxidative process wash and contact with an aqueous solution of an acid-binding agent before contacting with water and drying. In the preferred procedure the ammoniated material is washed for about 15 minutes at about 60° C in water containing about 4 to 8 percent real hydrogen peroxide and about 0.2 percent real of a surfactant, such as sodium lauryl sulfate or Deceresol® Surfactant P Special (a modified alkylarylsulfonate; American Cyanamid Company), based on the weight of the untreated material. The oxidized material is then contacted with an aqueous solution containing about 6.5 percent by weight of real sodium hydroxide based on the weight of the untreated material. The caustic-washed material is then rinsed in water at about 60° C and tumble dried for about 2 minutes at about 107° C. The drying temperature is not critical.

In the examples which follow the durability of the flame retardance is determined by subjecting the treated material to 50 home launderings, i.e., 50 washes and 50 dryings in accordance with Test Method 124-1973 of the American Association of Textile Chemists and Colorists, except that the water hardness is 150 parts per million. The flame retardance is determined by measuring char lengths of the treated material in accordance with the Department of Commerce Standard for Flammability of Children's Sleepwear, DOCFF3-71.

The following examples illustrate the process of this invention. All parts and percentages expressed are by weight unless otherwise noted. All viscosities are as measured at 25° C with a Brookfield viscometer.

EXAMPLE 1

A. Preparation of Condensation Product of Tetrakis (Hydroxymethyl)Phosphonium Sulfate and Urea (XYZ)

Solution A (632 grams), containing 85% by weight of tetrakis(hydroxymethyl)phosphonium sulfate (537.2 grams; 1.32 moles), is added to a suitable reaction vessel containing 100 grams of water and 74.0 grams of urea (1.23 moles). The mixture is stirred and heated at 100° C for ½ hour. The solution is then cooled to room temperature, filtered to remove suspended solids and 20 mls. of 3% aqueous hydrogen peroxide are added thereto to dispel a pinkish color. The final solution contains about 70% real solids, 10% phosphorus, as phosphonium phosphorus, and has a pH of about 2.1.

B. Preparation of Application Solutions

A pad bath is prepared containing 55.0 parts by weight of the above product, 0.1 part of a nonionic nonylphenol-ethylene oxide polyether alcohol (Deceresol® Surfactant NI Conc., American Cyanamid Co.), and 44.9 parts of water.

A second pad bath is prepared by mixing 1.0 part of a highly hydroxyethylated cellulose thickening agent (Natrosol® 250H; Hercules Powder Co.) and 99 parts of concentrated ammonium hydroxide (29% by weight of ammonia) in an Eppenbach stirrer. Vigorous stirring is continued until a clear solution having a viscosity of about 2100 centipoises is obtained. The temperature of the thickened ammonium hydroxide is then raised to about 35° C.

EXAMPLE 2

The following example illustrates the process of this invention:

Bleached, mercerized cotton sheeting (2.65 ounces per square yard) is immersed in the first pad bath of Example 1B, and passed between squeeze rolls at 60 psi to obtain about 100% wet pickup and deposit thereon about 5.5% phosphorus, based on the weight of the untreated fabric. The impregnated fabric is dried at 88° C for 1.5 minutes to obtain a fabric containing 3% moisture.

The partially-dried fabric is immersed in the second pad bath of Example 1B, and passed between squeeze rolls at 30 psi to obtain a wet pickup of about 40% and deposit thereon about 5 gram-moles of ammonia per gram-atom of phosphorus present thereon.

The ammonia-impregnated fabric is rolled and stored in a polyethylene bag at ambient temperature for 5 minutes, recovered from the bag and unrolled. The unrolled fabric is then subjected to an oxidation wash, rinsed with caustic, rinsed with water and dried. The treated material has good flame retardance initially and after 50 launderings. The results obtained are listed in Table I.

TABLE I

| | Char Length (inches) | | | | | |
|---|---|---|---|---|---|---|
| | Warp | | | Fill | | |
| Treated Material | 1 | 2 | 3 | 1 | 2 | Average |
| Initially | 2.9 | 2.4 | 2.1 | 2.4 | 2.3 | 2.4 |
| After 50 washes | 1.9 | 5.6 | 6.2 | 4.1 | 7.9 | 5.1 |

EXAMPLE 3

For comparison, the procedure of Example 2 is followed in every detail except that the thickening agent is not added to the ammonium hydroxide. The char lengths of the five samples of initial treatments and the five samples laundered fifty times are, in every case, 10 inches. These treated materials do not meet the DOCFF-3-71 test requirement on char length.

EXAMPLES 4–12

The procedure of Example 2 is followed in every detail except that the concentration of ammonia in the second pad bath is varied. This is accomplished by preparing a thickened ammonium hydroxide solution as in Example 1B and diluting aliquots of this solution with varying amounts of a thickened aqueous solution, prepared by slowly adding 10.0 grams of hydroxyethylated cellulose (Natrosol® 250H) per liter of vigorously stirred water. The final thickened pad baths all have a viscosity of 2000 cps at 25° C but contain 14.5%, 18.8%, and 23.2% by weight ammonia, respectively. A comparison example with 29.0% ammonia is also included. The results obtained after 50 washes, as listed in Table II, show that specimens immersed in a pad bath containing about 14.5% ammonia do not meet the Department of Commerce requirement on char length after 50 washes.

TABLE II

| Example | (a) $[NH_3]$ % | Reaction Time (mins.) | Char Length (inches) Warp 1 | Warp 2 | Warp 3 | Fill 1 | Fill 2 | Average |
|---|---|---|---|---|---|---|---|---|
| 4 | 29.0 | 1 | 2.5 | 1.6 | 2.4 | 4.6 | 1.6 | 2.5 |
| 5 | " | 5 | 2.2 | 3.6 | 3.0 | 3.6 | 1.3 | 2.7 |
| 6 | 23.2 | 5 | 5.2 | 4.8 | 5.5 | 1.5 | 2.3 | 3.9 |
| 7 | " | 15 | 2.0 | 5.5 | 2.6 | 0.8 | 5.3 | 3.2 |
| 8 | " | 30 | 1.0 | 4.8 | 1.5 | 1.0 | 3.1 | 2.3 |
| 9 | 18.8 | 15 | 5.7 | 10.0 | 2.0 | 1.7 | 4.7 | 4.8 |
| 10 | " | 30 | 1.8 | 4.2 | 1.0 | 1.5 | 1.0 | 1.9 |
| 11 | 14.5 | 30 | 10.0 | 10.0 | 2.5 | 10.0 | 10.0 | 8.5 |
| 12 | " | 60 | 8.1 | 10.0 | 10.0 | 1.6 | 10.0 | 7.9 |

(a) Percent real ammonia based on the weight of the thickened ammonium hydroxide.

EXAMPLES 13–24

The procedure of Example 2 is followed except that there is 10 percent moisture on the partially dried fabric after treatment with the first pad bath; the temperature of the second pad bath is varied from about 21.1° C to about 37.8° C; and the reaction time after emergence from the thickened ammonium hydroxide and prior to the process washing is varied from about 5 to about 60 minutes. The results obtained after 50 washes are listed in Table III. These results show that improved results are obtained at about 32° C to about 38° C.

TABLE III

| Ex. | (a) ° C | Reaction Time (mins.) | Char Length (inches) Warp 1 | Warp 2 | Warp 3 | Fill 1 | Fill 2 | Average |
|---|---|---|---|---|---|---|---|---|
| 13 | 37.8 | 5 | 10.0 | 5.4 | 1.7 | 1.4 | 10.0 | 5.7 |
| 14 | 37.8 | 30 | 1.7 | 1.5 | 2.0 | 1.5 | 1.3 | 1.6 |
| 15 | 37.8 | 60 | 0.9 | 1.7 | 1.5 | 0.9 | 1.9 | 1.4 |
| 16 | 32.2 | 5 | 1.7 | 1.8 | 1.5 | 1.5 | 2.5 | 1.8 |
| 17 | 32.2 | 30 | 3.8 | 4.6 | 2.5 | 1.8 | 2.2 | 3.0 |
| 18 | 32.2 | 60 | 4.0 | 1.9 | 1.7 | 10.0 | 1.3 | 3.8 |
| 19 | 21.1 | 5 | 10.0 | 1.8 | 1.8 | 2.5 | 1.8 | 3.6 |
| 20 | 21.1 | 5 | 10.0 | 2.8 | 4.4 | 5.2 | 5.9 | 5.7 |
| 21 | 21.1 | 5 | 10.0 | 1.7 | 7.8 | 10.0 | 1.7 | 6.0 |
| 22 | 21.1 | 5 | 10.0 | 10.0 | 1.4 | 10.0 | 2.1 | 6.7 |
| 23 | 21.1 | 30 | 2.6 | 6.0 | 5.5 | 4.0 | 1.5 | 3.9 |
| 24 | 21.1 | 60 | 6.0 | 10.0 | 7.4 | 3.8 | 10.0 | 7.4 |

(a) Temperature of thickened ammonium hydroxide.

EXAMPLES 25–34

A pad bath is prepared comprising 50.0% of the product of Example 1A, 3.4% sodium acetate, 0.1% of a trimethylnonyl polyethyleneglycol ether (Tergitol® TMN-6, Union Carbide Company) and 46.5% water.

Three pad baths are prepared containing concentrated ammonium hydroxide and sufficient thickening agent (Natrosol® 250H) to adjust the viscosities to 800, 2000 and 6000 centipoises at 25° C, respectively. The temperatures of the thickened ammonium hydroxide pad baths are 21° C in all cases.

Samples of bleached, mercerized cotton sheeting (2.65 oz./sq. yd.) are immersed in the first pad bath and processed as described in Example 2 to deposit thereon about 5.0% phosphorus and partially dried to 5–15% moisture. The partially dried fabrics are immersed in the second pad baths and processed to deposit thereon about 5 gram-moles of ammonia per gram-atom of phosphorus present thereon.

The ammonia-impregnated fabrics are then rolled and further processed as described in Example 2. The results obtained are listed in Table IV. These results show improved flame resistance at a viscosity of 2000 centipoises.

TABLE IV

| Example | % Moisture | Viscosity | (a) Char Length (inches) 25 Washes | (b) 50 Washes |
|---|---|---|---|---|
| 25 | 15 | 800 | 10.0 | 6.8 (3/5) |
| 26 | 15 | 800 | 10.0 | 4.1 (1/5) |
| 27 | 5 | 2000 | 5.1 | 5.4 (2/5) |
| 28 | 8 | 2000 | 8.0 | 6.2 (1/5) |
| 29 | 15 | 2000 | 2.2 | 5.0 (1/5) |
| 30 | 15 | 2000 | 2.4 | 5.3 |
| 31 | 15 | 2000 | 2.2 | 6.0 (1/5) |
| 32 | 5 | 6000 | 7.5 | 5.2 (1/5) |
| 33 | 8 | 6000 | 3.4 | 6.2 (2/5) |
| 34 | 15 | 6000 | 2.2 | 5.4 (1/5) |

(a) Char lengths are averages of five specimens.
(b) Char lengths are averages of those fabrics not burned entirely. The figures in parentheses show the number of fabrics out of five that were burned entirely. Thus, 3/5 indicates that 3 fabrics out of 5 burned entirely.

EXAMPLES 35–44

The procedures of Examples 1B and 2 are used except that 1.0 gram of an anionic heteropolysaccharide (Biopolymer® XB-23 Xanthan Gum; General Mills Chemicals, Inc.), 1.0 gram of a natural gum derived from the ground endosperms of guar seed (Jaguar® A-20-D; Stein Hall Company), 2.0 grams of a purified carob seed gum ether (Polygum® 260; Polymer Industries) and 20.0 grams of a concentrated starch (Ambertex® Gum; National Starch and Chemical), respectively, are used as the thickening agent instead of 1.0 gram of Natrosol® 250-H. A comparison experiment utilizing 1.0 gram of Natrosol® 250-H is also included. The results, listed in Table V, show that superior flame retardance is obtained with the Natrosol® 250-H.

TABLE V

| Example | Thickener | Viscosity (CPS) | Reaction Time(mins.) | Char Length (inches) Warp 1 | Warp 2 | Warp 3 | Fill 1 | Fill 2 | Average |
|---|---|---|---|---|---|---|---|---|---|
| 35 | Biopolymer® XB-23 | 2500 | 5 | 6.4 | 10.0 | 10.0 | 8.5 | 4.4 | 7.9 |
| 36 | " | " | 30 | 10.0 | 3.3 | 10.0 | 4.4 | 1.8 | 5.9 |
| 37 | Polygum® 260 | 2300 | 5 | 10.0 | 10.0 | 1.8 | 10.0 | 10.0 | 8.4 |
| 38 | " | " | 30 | 5.2 | 2.6 | 10.0 | 9.1 | 2.4 | 5.9 |
| 39 | Ambertex® Gum | 1900 | 5 | 10.0 | 1.4 | 1.6 | 8.2 | 1.4 | 4.5 |
| 40 | " | " | 30 | 10.0 | 4.5 | 10.0 | 7.9 | 6.4 | 7.8 |
| 41 | Jaguar® A-20-D | 2100 | 5 | 10.0 | 10.0 | 10.0 | 7.2 | 1.2 | 7.7 |
| 42 | " | " | 30 | 10.0 | 4.2 | 3.5 | 4.2 | 7.4 | 5.9 |
| 43 | Natrosol® 250-H | 2000 | 5 | 2.3 | 1.6 | 3.5 | 1.7 | 1.2 | 2.1 |

TABLE V-continued

| Example | Thickener | Viscosity (CPS) | Reaction Time(mins.) | Char Length (inches) Warp 1 | Warp 2 | Warp 3 | Fill 1 | Fill 2 | Average |
|---|---|---|---|---|---|---|---|---|---|
| 44 | " | " | 30 | 1.9 | 1.9 | 4.1 | 2.1 | 6.7 | 3.3 |

EXAMPLES 45–47

Pad baths are prepared comprising the compositions of Table VI.

TABLE VI

| Example | Product of Example 1 (%) | Tergitol® TMN-6 (%) | Water (%) |
|---|---|---|---|
| 45 | 55.0 | 0.1 | 44.9 |
| 46 | 62.0 | 0.1 | 37.9 |
| 47 | 70.0 | 0.1 | 29.9 |

EXAMPLES 48–56

The compositions of Examples 45, 46, and 47 are applied by padding to bleached, mercerized cotton sheeting (2.65 ounces per sq. yd.), commercial cotton sheeting (4.5 ounces per sq. yd.), and commercial cotton duck (7.2 ounces per sq. yd.), respectively, and dried at 88° C to provide a partially dried material which contains in each instance about 5.5% phosphorus and about 3% moisture based on the weight of the untreated material.

Thickened ammonium hydroxide is prepared by slowly adding 10.0 grams of Natrosol® 250-H to one liter of vigorously stirred concentrated ammonium hydroxide (29% by weight ammonia) in an Eppenbach mixer. Vigorous stirring is continued until a clear solution is obtained having a viscosity of about 2000 centipoises and the temperature is then raised to about 32° C.

The partially dried fabrics are impregnated with the thickened ammonium hydroxide, passed between squeeze rolls, rolled, stored in plastic bags for varying periods of time, washed and dried, as described in Example 2. The results obtained after 50 washes, as listed in Table VII, show that superior flame retardance is obtained with the cotton duck.

The results for cotton sheeting, 2.65 and 4.5 ounces per sq. yd., are reported under Examples 48–50, and 51–53, respectively. The results for cotton duck are reported under Examples 54–56.

TABLE VII

| Ex. | Pad Bath of Example | Reaction Time(mins.) | Char Length (inches) Warp 1 | Warp 2 | Warp 3 | Fill 1 | Fill 2 | Average |
|---|---|---|---|---|---|---|---|---|
| 48 | 45 | 1 | 0.9 | 1.6 | 1.7 | 3.8 | 2.9 | 2.2 |
| 49 | 45 | 5 | 1.4 | 1.6 | 0.8 | 3.2 | 1.5 | 1.7 |
| 50 | 45 | 30 | 2.7 | 2.8 | 2.4 | 4.1 | 3.9 | 3.2 |
| 51 | 46 | 1 | 1.3 | 2.1 | 1.3 | 4.4 | 1.5 | 2.1 |
| 52 | 46 | 5 | 1.5 | 1.5 | 4.6 | 4.1 | 8.2 | 4.0 |
| 53 | 46 | 30 | 2.6 | 1.4 | 1.7 | 2.8 | 1.0 | 2.0 |
| 54 | 47 | 1 | 2.8 | 0.4 | 0.5 | 1.5 | 0.2 | 1.1 |
| 55 | 47 | 5 | 0.4 | 0.4 | 0.4 | 0.3 | 2.3 | 0.8 |
| 56 | 47 | 30 | 0.2 | 0.3 | 0.3 | 0.3 | 0.3 | 0.3 |

EXAMPLES 57–60

A pad bath is prepared containing 55.0 parts of the product of Example 1A, 1.8 parts of sodium acetate, 0.1 part of a trimethylnonyl polyethylene glycol ether surfactant (Tergitol® Nonionic TMN-6; Union Carbide Co.) and 44.1 parts of water.

A second application solution is prepared as described above except that the sodium acetate is omitted and 45.9 parts of additional water are used.

Cotton sheeting (2.65 ounces/sq. yd.) is passed into the application solutions, described above, and then passed into a thickened ammonium hydroxide solution prepared as described in Example 1B, and processed as described in Example 2. The results obtained, with and without the inclusion of sodium acetate, listed in Table VIII under Examples 57–58 and 59–60, respectively, show that the inclusion of sodium acetate does not improve the flame retardancy.

TABLE VIII

| Example | (a) Reaction Time(mins.) | Char Length (inches) Warp 1 | Warp 2 | Warp 3 | Fill 1 | Fill 2 | Average |
|---|---|---|---|---|---|---|---|
| 57 | 5 | 1.3 | 1.4 | 1.6 | 2.0 | 1.7 | 1.6 |
| 58 | 30 | 1.9 | 1.6 | 1.4 | 1.7 | 4.7 | 2.3 |
| 59 | 5 | 0.9 | 1.3 | 1.3 | 1.1 | 0.9 | 1.1 |
| 60 | 30 | 2.3 | 1.2 | 1.6 | 2.1 | 1.3 | 1.7 |

(a) Time ammoniated-material held in plastic bag before process washing.

I claim:

1. A process for rendering a cellulosic textile material flame-resistant comprising;

impregnating the material with an aqueous solution of a partially polymerized methylolated phosphorus compound, prepared by reacting from about 4.0 to about 9.0 parts by weight of tetrakis(hydroxymethyl)phosphonium sulfate with about 1.0 part by weight of urea, to deposit thereon about 3.0–7.0 weight % phosphorus based on the weight of the untreated textile material;

partially drying the impregnated textile material;

impregnating the partially dried textile material with a thickened aqueous solution of ammonium hydroxide containing about 17–29% by weight of ammonia and sufficient water soluble thickening agent to provide a solution viscosity of about 500–10,000 centipoises at 25° C to deposit thereon about 2–6 gram-moles of ammonia per gram-atom of phosphorus present thereon, the temperature of the thickened ammonium hydroxide ranging from about 20° C. to about 60° C;

rolling the ammonium hydroxide-impregnated textile material;

storing the rolled material in a suitable sealed container for about ½-60 minutes at ambient temperature to allow the formation of an unsoluble polymer within the rolled material from the reaction of said phosphorous compound and ammonium hydroxide impregnated therein;

recovering and unrolling the stored textile material; rinsing the unrolled textile material with water; and drying the treated textile material.

2. The process according to claim 1 wherein the textile material is impregnated to deposit thereon about 3.5–5.0% by weight phosphorus; the thickened ammonium hydroxide contains about 25–29% by weight ammonia, has a viscosity of about 1,000–3,000 centipoises at 25° C and a temperature about 30°–45° C; and the ammonium hydroxide-impregnated textile material contains about 4–5 gram-moles of ammonia per gram-atom of phosphorus present thereon and is stored about 1–5 minutes before recovering, unrolling, rinsing and drying.

3. The process according to claim 1 with the additional steps of successively washing and unrolled, ammonium hydroxide-impregnated textile material with a dilute aqueous solution of hydrogen peroxide and then a dilute aqueous solution of an acid-binding agent, before said rinsing and drying thereof.

4. The process according to claim 2 with the additional steps of successively washing the unrolled, ammonium hydroxide-impregnated textile material with a dilute aqueous solution of hydrogen peroxide and then a dilute aqueous solution of an acid-binding agent, before said rinsing and drying thereof.

5. The process according to claim 1 wherein the cellulosic textile material is 100% cotton fabric.

6. The process according to claim 5 wherein the fabric is cotton duck.

7. The process according to claim 5 wherein the fabric is cotton sheeting.

8. The process according to claim 3 wherein the cellulosic textile material is 100% cotton fabric.

9. The process according to claim 8 wherein the fabric is cotton duck.

10. The process according to claim 8 wherein the fabric is cotton sheeting.

11. The flame-resistant cellulosic textile material obtained by the process of claim 1.

12. The flame-resistant cellulosic textile material obtained by the process of claim 2.

13. The flame-resistant cellulosic textile material obtained by the process of claim 3.

14. The flame-resistant cellulosic textile material obtained by the process of claim 4.

* * * * *